US005100356A

United States Patent [19]

Atwell

[11] Patent Number: 5,100,356

[45] Date of Patent: Mar. 31, 1992

[54] FLYING TOY

[76] Inventor: Blair Atwell, 1064 E. 2nd St., Longbeach, Calif. 90802

[21] Appl. No.: 472,735

[22] Filed: Jan. 31, 1990

[51] Int. Cl.[5] ..... A63H 27/00

[52] U.S. Cl. ..... 446/48; D21/86; 446/112; 446/46

[58] Field of Search ..... 446/45–48, 446/111, 112, 93, 94; 273/424, 425, 428, 427; D21/86, 85

[56] References Cited

U.S. PATENT DOCUMENTS

| | | | |
|---|---|---|---|
| 2,304,215 | 12/1942 | Streubel | 446/48 |
| 3,673,732 | 7/1972 | Liotta | 446/48 |
| 4,112,612 | 9/1978 | Woods | 446/48 |
| 4,182,073 | 1/1980 | Tabet | 446/46 |
| 4,265,454 | 5/1981 | Bayless | 273/427 |
| 4,307,535 | 12/1981 | Martin | 446/48 |
| 4,436,264 | 3/1984 | Brumfield . | |

OTHER PUBLICATIONS

"Googolplex", Arlington-Hews of Canada Ltd., Vancouver, Canada, 1987.

*Primary Examiner*—Mickey Yu
*Attorney, Agent, or Firm*—Ladas & Parry

[57] ABSTRACT

A flying projectile toy having an individual flying unit that is connectable to an adjacent individual flying unit, or plurality of units, to form a combined structure. Each individual unit has a top wall with an off-center hole therein, sloped side walls extending downwards from the top wall and abutment wall extending directly downwards from the sloped side walls. The top wall, side walls, and abutment walls define the airfoil shape for the individual flying unit. To enhance the flight characteristics of the individual flying unit, the abutment walls have a greater thickness than the top wall and side walls, and stepped ridges are formed on the side walls.

9 Claims, 8 Drawing Sheets

FLYING TOY

FIELD OF THE INVENTION

The present invention relates to flying projectile toy which can be used as an individual flying unit or as an assembly of individual flying units connected together.

BACKGROUND OF THE INVENTION

In the field of flying toys, such as the FRISBEE, an individual disc is thrown back-and-forth among the participating individuals. The flight characteristics and the appearance of these flying toys are limited by the configuration of a single disc or by flight altering attachments applied to the single disc. Lacking in these toys is the creative freedom for the user to construct various flying structures, from a combination of individual flying units, that have differing flight characteristics and shapes.

SUMMARY OF THE INVENTION

An object of the present invention is to provide a flying projectile toy that enables the user of the toy to design various structures, with different flying characteristics, by connecting individual flying units together. The flying toy includes individual flying units and connecting means for connecting the individual flying units together in various configurations. Depending on the position and orientation of the individual flying units and the connecting means, and the number of individual flying units and connecting means used, the appearance and flying characteristics of the flying toy can be varied. Preferably, however, the individual flying units are connected in the horizontal and vertical directions by horizontal and vertical connecting means.

An individual flying unit includes a top wall, sloped side walls extending downwards from the top wall and abutment walls extending downwards from the side walls. The top wall, side walls, and abutment walls define the airfoil shape for the individual flying unit.

To enhance the flight characteristics of the flying toy projectile, the individual flying unit preferably includes an off-center hole in the top wall and stepped ridges formed on the side walls. Additionally, the stability of an individual flying unit, while in flight, is enhanced by having the thickness of the abutment walls greater than the thickness of the top wall and side walls.

To connect individual flying units together, a plurality of openings are provided in the individual flying unit for receiving detachable connecting means. The openings are spaced around the individual flying unit and include receiving holes for locking cooperation with vertical connecting means and slots, in conjunction with shoulder means formed on the inside surfaces of the abutment walls, for locking cooperation with horizontal connecting means. Preferably, the vertical connecting means is a pole and the horizontal connecting means is a clip with extending prongs engageable with the shoulder means, although various other connecting means can be used to connect individual flying units together. Additionally, the individual flying unit preferably has a polygonal shape and the abutment walls are flat, for a tight abutment among adjacent individual flying units when the individual flying units are connected together, although other shapes can be used. Additionally, the individual flying unit uses a foil loading (as described by weight divided by area) on each polygonal foil between the range of 0.0375 oz./sq. in. and 0.0546 oz./sq. in. and the optimal performance is found at 0.0375 oz./sq. in. with the individual flying unit weighing 16.5 gms. plus or minus 0.5 gms.

Other objects, features, and advantages of the invention will be apparent from the following detailed description of a preferred embodiment, with reference to the accompanying drawings.

DETAILED DESCRIPTION OF THE PREFERRED EMBODIMENT

Figure 1:
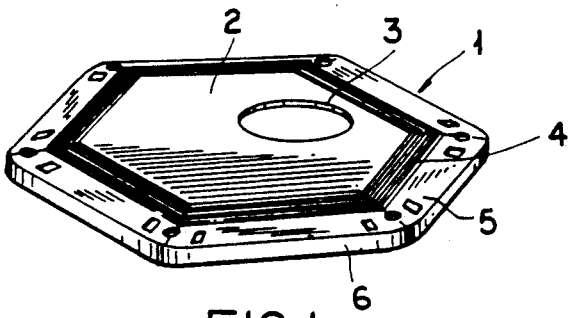
FIG. 1 is a perspective view of an individual flying unit of the present invention.

Referring to the drawings in detail, the flying toy projectile includes, as shown in FIGS. 1–5, an individual flying unit 1 having a top wall 2, sloped side walls 5 extending downwards from the top wall and abutment walls 6 extending directly downwards from the side walls. Top wall 2, side walls 5 and abutment walls 6 define the airfoil shape for the individual flying unit. Individual flying unit 1 is preferably molded from a plastics material, although the particular material from which the body is formed and the method used to form it are not important and any standard materials and forming methods can be used.

The individual flying unit has an off-center hole 3, in top wall 2, which affects the airflow about the unit when it is flying, so that the roll instability, common to rotating flying toys, is overcome. The off-center hole also affects the flying characteristics of connected units so that the positioning of the off-center holes can vary how the connected structure flies. For example, the structure shown in FIGS. 11-14 illustrates the off-center holes alternately aligned in a stack. In this arrangement, the off-center holes stabilizes the entire structure (i.e. maintains level flight) by bouncing air off bottom surface 19 of top wall 2, inner side surfaces 20 of side walls 5, and inside surfaces 21 of abutment walls 6. As is shown in FIGS. 6-10 and 15-19, various other flying toy structures can be assembled. In all of these fly toy structures, as well as many other possible structures not shown in the drawings, varying the positioning of the off-center hole 3, with respect to the off-center holes of the other individual flying units, adjusts the flight characteristics of the whole structure.

Also affecting the flight characteristics of individual flying unit 1 are abutment walls 6. As shown in FIGS. 1-5, abutment walls 6 are arranged about the periphery of individual flying unit 1 in a hexagon shape and preferable have a thickness greater than side walls 5 and top wall 2 so that a more turbulent flow is created which causes the center of lift to move towards the center of mass as the individual flying unit is flying. The abutment walls also have a vertical height that is preferable less than half the height of individual flying unit 1 as measured from bottom edge 9 of the abutment walls 6 to top surface 23 of top wall 2. Furthermore, when a plurality of individual flying units are connected together in the horizontal direction, the adjacent abutment walls of connected individual flying units abut one another.

Figure 4:
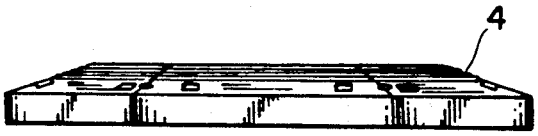
FIG. 4 is a side view of the individual flying unit.
Figure 5:
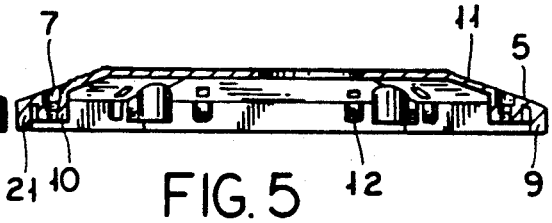
FIG. 5 is a cross sectional view of the individual flying unit along line V—V of FIG. 2.
Figure 6:
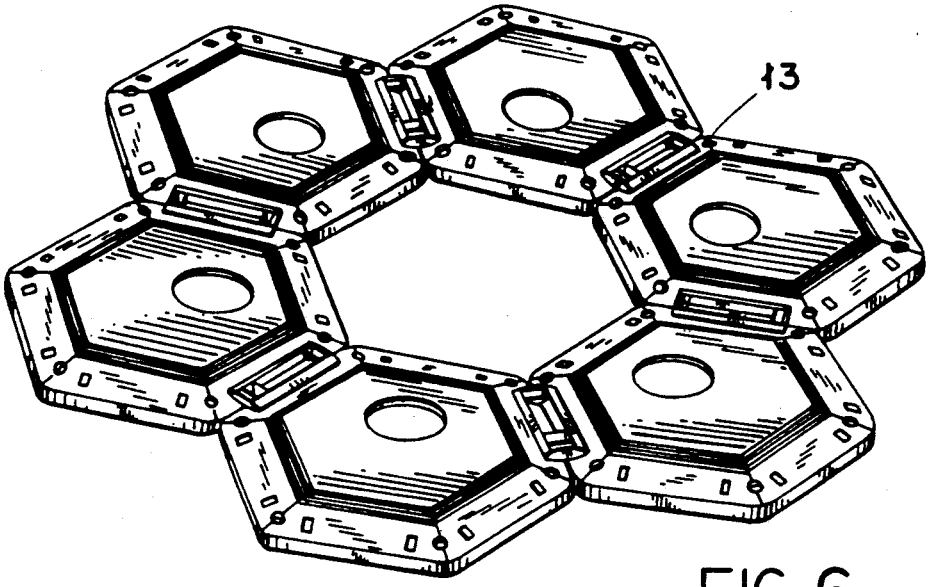
FIG. 6 is a perspective view of a first configuration of individual flying units assembled together in the same horizontal plane.
Figure 7:
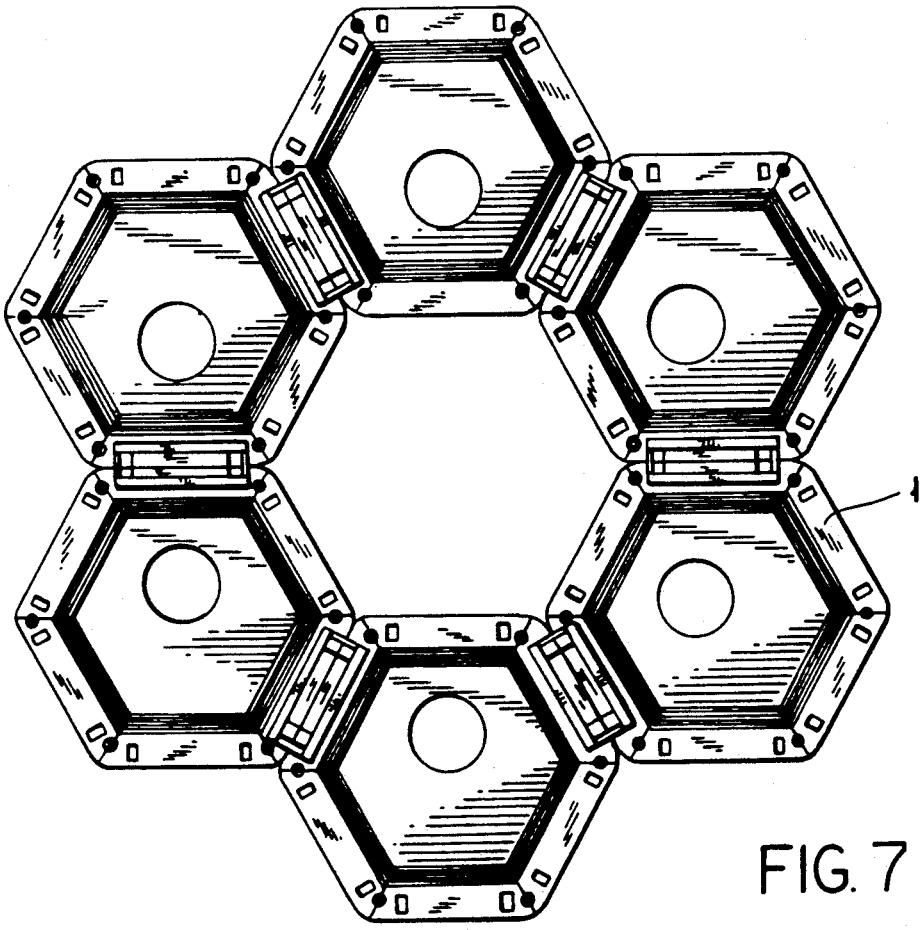
FIG. 7 is a top view of the first configuration.
Figure 8:
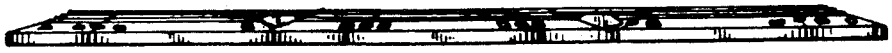
FIG. 8 is a side view of the first configuration.
Figure 9:
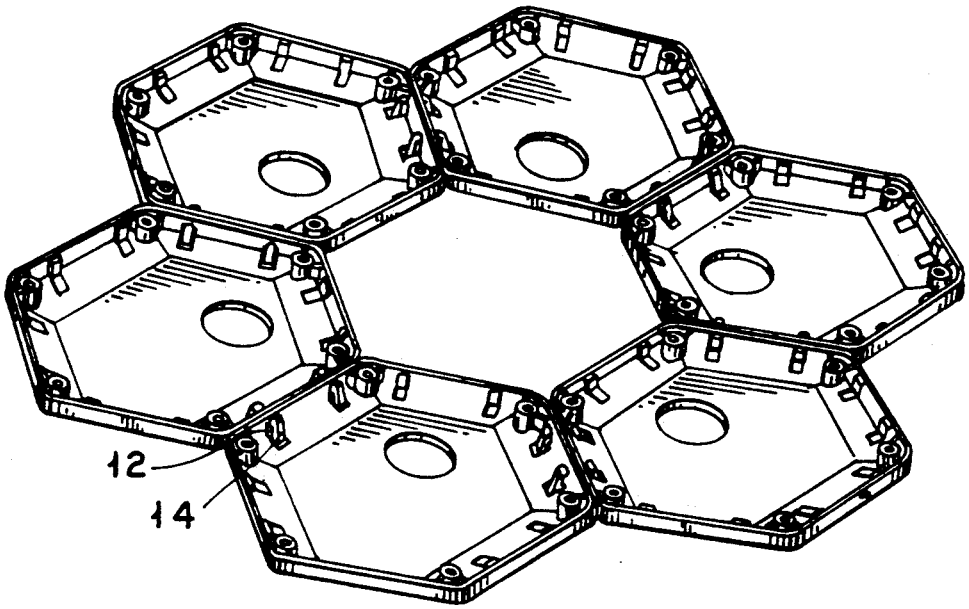
FIG. 9 is a bottom view of the first configuration.

To further enhance the flight characteristics of the individual flying unit, stepped ridges 4 are formed on the outer surface 11 of side walls 5. As best shown in FIGS. 4 and 5, stepped ridges 4 are formed as part of side walls 5 and are preferable positioned on the upper part of side walls 5. The effect of the stepped ridges is that they create a turbulent "burbling" flow that provide greater lift to the individual flying unit as it is flying.

Figure 2:
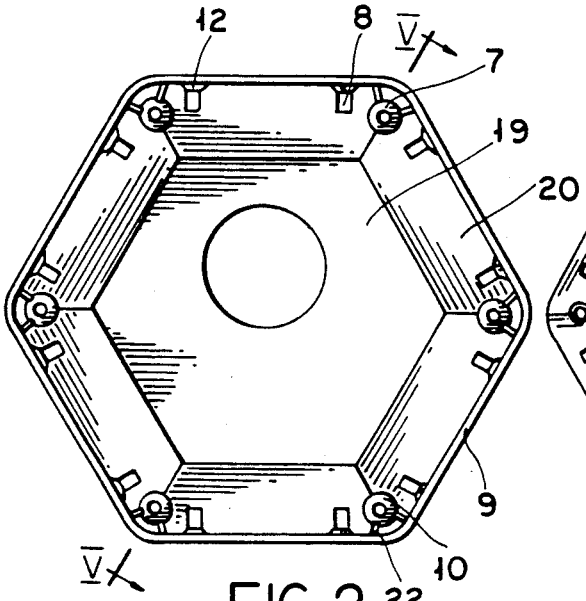
FIG. 2 is a bottom view of the individual flying unit.
Figure 3:
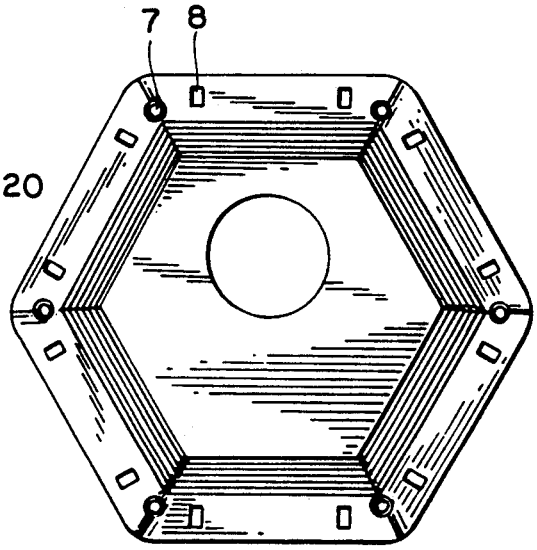
FIG. 3 is a top view of the individual flying unit.

To connect individual flying units together, a plurality of openings 7, 8 are provided about the individual flying unit for receiving detachable connecting means 13, 17. Looking specifically at FIGS. 2-5, receiving holes 7 are equally spaced about the unit with a plurality of slots 8 equally spaced between receiving holes 7. As best shown in FIGS. 2 and 5, receiving holes 7 pass through side walls 5 and through hole support portion 10 which extends downwards from side walls 5 and is connected to inside surfaces 21 by brace 22. Also shown in FIGS. 2-5, and in FIGS. 9, 14 and 19, slots 8 passes through side walls 5 so that a shoulder means 12, formed on inside surfaces 21 is positioned adjacent to each slot 8.

Figure 10:
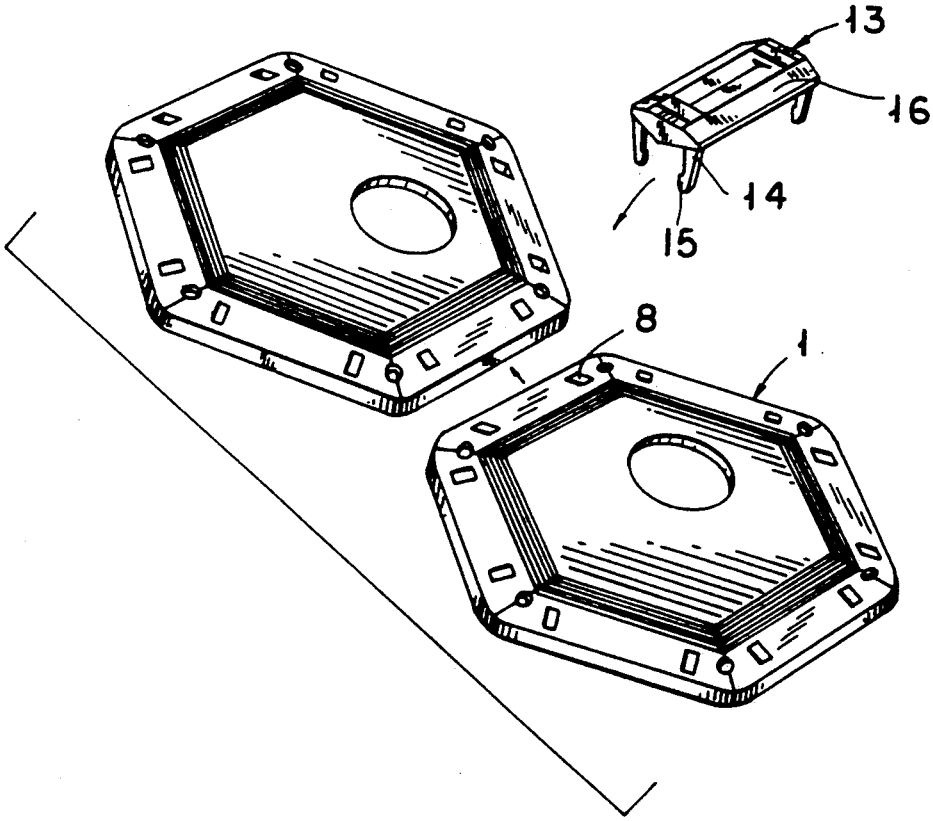
FIG. 10 is an exploded perspective view of adjacent individual flying units and the horizontal connecting means connecting the individual flying units together.
Figure 11:
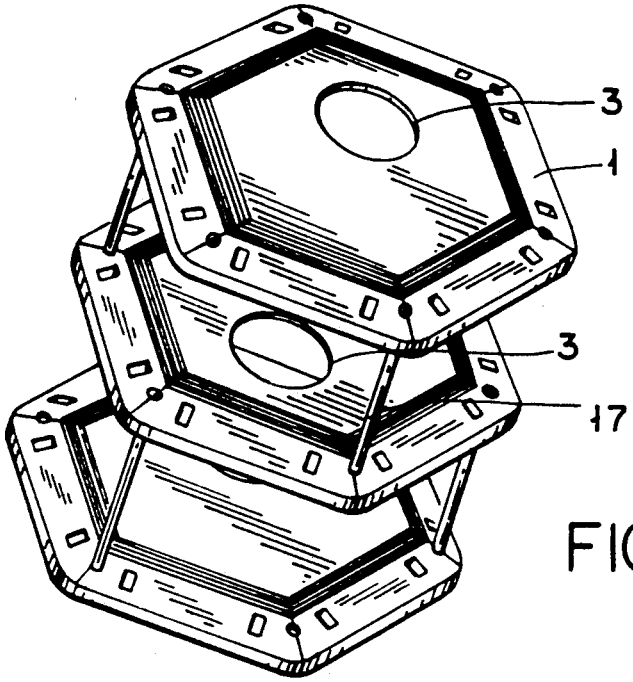
FIG. 11 is a perspective view of a second configuration of individual flying units assembled together in different horizontal planes.
Figure 12:
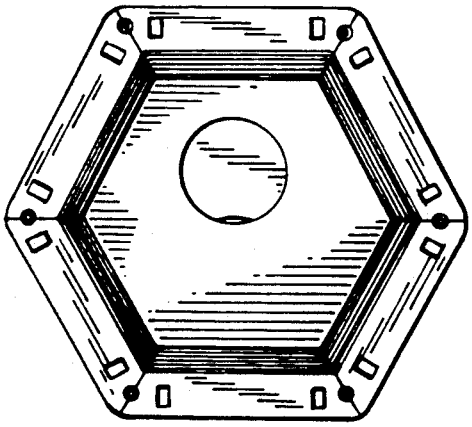
FIG. 12 is a top view of the second configuration.
Figure 13:
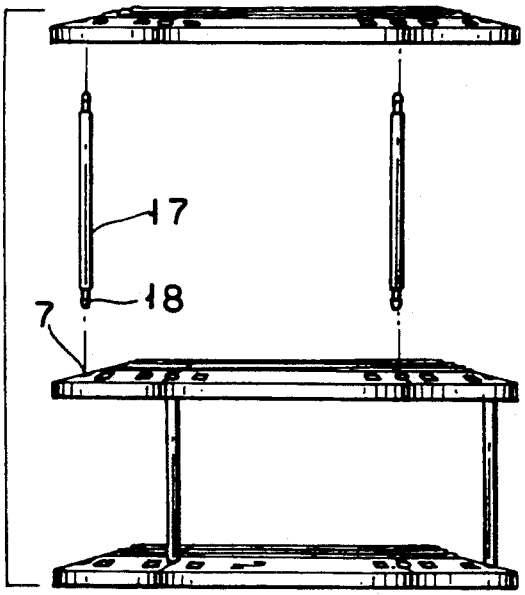
FIG. 13 is an exploded side view of adjacent individual flying units and the vertical attachment means connecting the individual flying units together.
Figure 14:
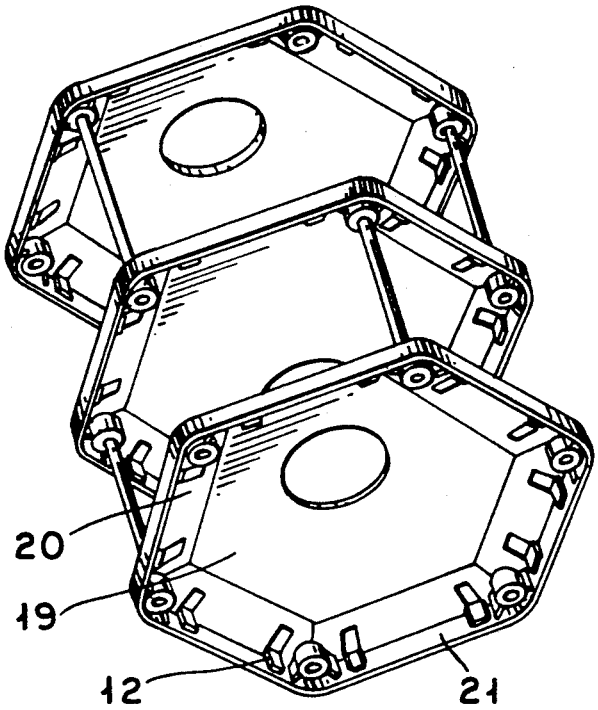
FIG. 14 is a perspective bottom view of the second configuration.
Figure 15:
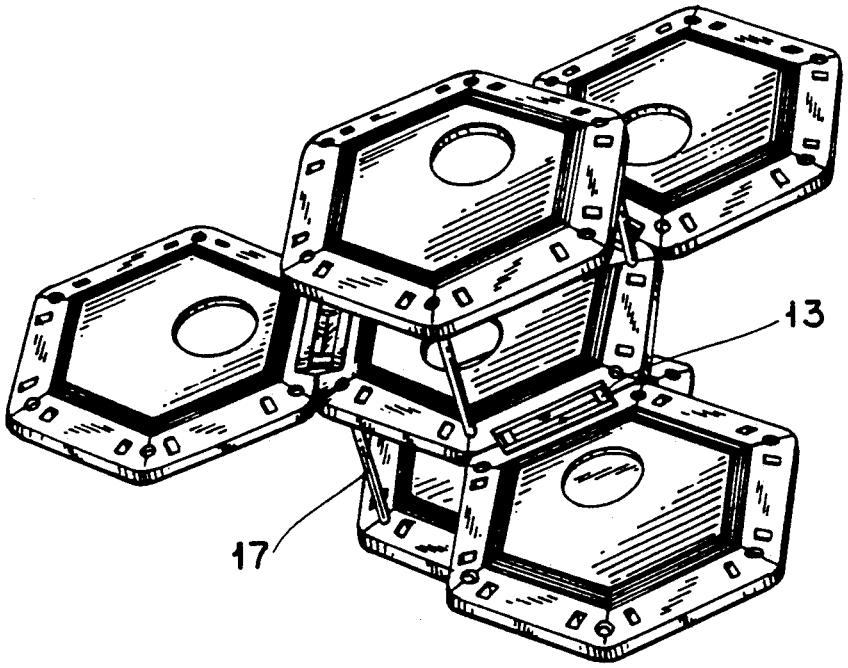
FIG. 15 is a perspective view of a third configuration of individual flying units assembled together in different horizontal planes and along different vertical axis.
Figure 16:
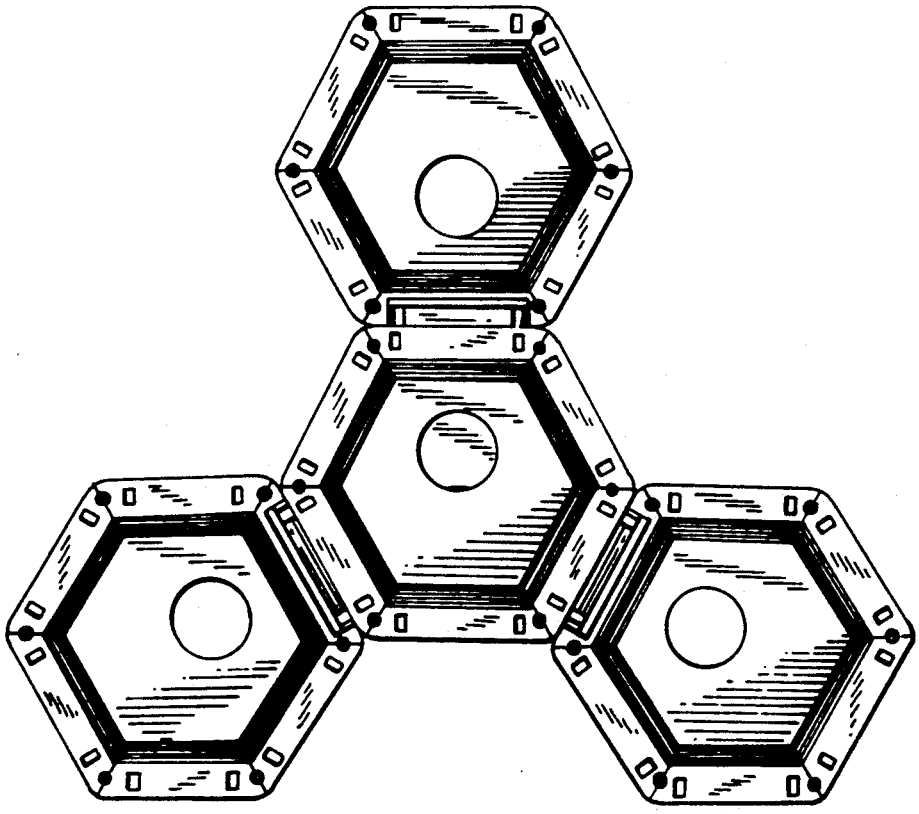
FIG. 16 is a top view of the third configuration.
Figure 17:
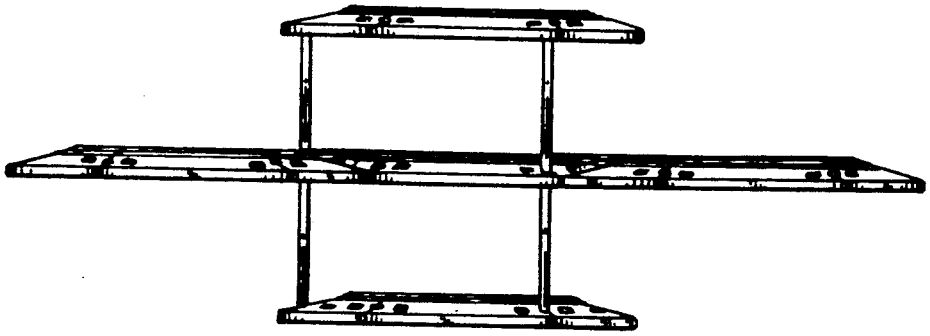
FIG. 17 is a side view of the third configuration.
Figure 18:
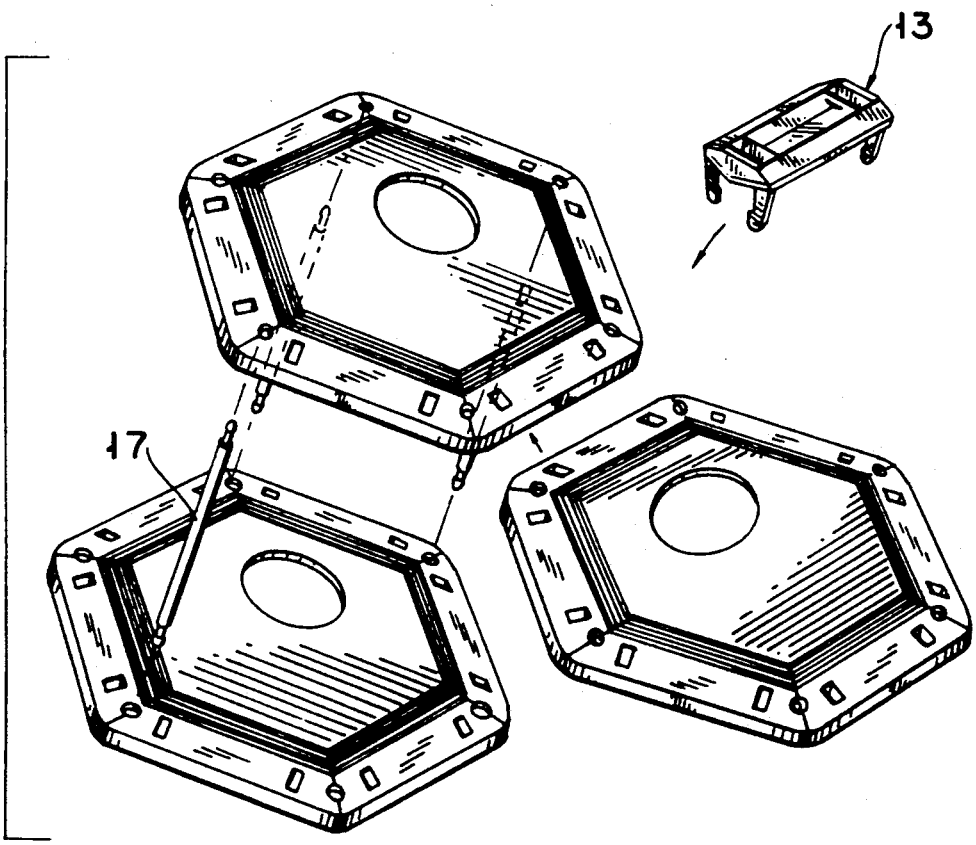
FIG. 18 is an exploded perspective view of adjacent individual flying units and the horizontal and vertical connecting means connecting the individual flying units together.
Figure 19:
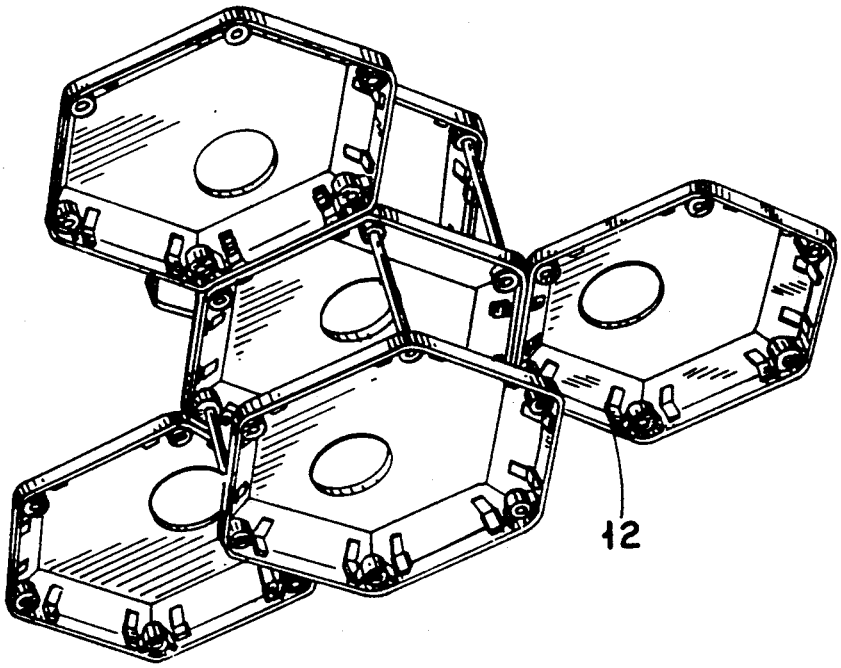
FIG. 19 is a bottom perspective view of the third configuration.

In FIGS. 10, 13 and 18, the connection of individual units is shown. More particularly, FIGS. 10 and 18 shown a clip 13 that horizontally connects individual flying units together along vertical abutment walls 6. To connect individual flying units together, prongs 4, extending from connecting portion 16 of clip 13, are inserted into adjacent sets of slots 8 in each respective individual flying unit. As prong 14 are inserted into slots 8, tabs 15 on the prongs engage shoulders means 12 to lock clip 13 to the individual flying units and join the adjacent individual flying units together.

To vertically connect individual flying units together, as best shown in FIGS. 13 and 18, tip portions 18 of poles 17 are inserted into receiving holes 7 to lock poles 17 to the adjacent individual flying units. As further shown in FIGS. 13 and 18, a plurality of poles are used to connect adjacent individual flying units together. Further shown in FIG. 18 are individual flying units connected together by both clips 13 and poles 17. Both clips 13 and poles 17, are detachable from the units and are interchangeable between units.

To use the flying toy projectile, the user grasps the individual flying unit and imparts a rotation to the individual flying unit as it is being thrown. The flying toy projectile can also be flown as a combined structure of identical individual flying units connected together as shown in FIGS. 6-19. As with the individual flying unit, the user grasps the combined structure and imparts a rotation to the combined structure as it is being thrown.

I claim:

1. A flying toy comprising:

an individual flying unit having structures to create a pressure differential that allows said individual flying unit to fly when launched substantially horizontally in the air; and connecting means, engageable with said individual flying unit, to connect individual flying units together in both the horizontal and vertical directions.

2. The flying toy according to claim 1, wherein the individual flying unit comprises a top wall, sloped side walls extending downwards from said top wall and abutment walls extending directly downwards from said side walls.

3. The flying toy according to claim 2, wherein the top wall has an off-center hole defined therein.

4. The flying toy according to claim 3, further comprising stepped ridges formed on outside surfaces of the side walls.

5. The flying toy according to claim 4, wherein the abutment walls have a greater thickness than the top wall and side walls.

6. The flying toy according to claim 5, wherein a plurality a receiving holes around the individual flying unit cooperate with vertical connecting means to connect individual flying units together in the vertical direction, and slots in the individual flying unit, in combination with shoulders means extending from the abutment wall adjacently positioned by the slots, cooperate with the horizontal connecting means to connect individual flying units together in the horizontal direction.

7. The flying toy according to claim 6, wherein the vertical connecting means is a pole and the horizontal connecting means is a clip having extending prongs that pass through the slots and engage the shoulder means to attach said clip to the individual flying unit.

8. The flying toy according to claim 7, wherein the individual flying unit is molded from a plastics material and has a hexagon shape.

9. A flying toy comprising:

a plurality of identical individual flying units wherein each said individual flying unit having structures to create a pressure differential that allows each said individual flying unit to fly when launched substantially horizontally in the air; and vertical and horizontal connecting means, engageable with each said individual flying unit, to connect individual flying units together in both the horizontal and vertical directions.

* * * * *